US006796130B2

(12) United States Patent
Little et al.

(10) Patent No.: US 6,796,130 B2
(45) Date of Patent: Sep. 28, 2004

(54) INTEGRATED COMBUSTOR AND NOZZLE FOR A GAS TURBINE COMBUSTION SYSTEM

(75) Inventors: David Allen Little, Chuluota, FL (US); Thomas E. Lippert, Murrysville, PA (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 10/289,573

(22) Filed: Nov. 7, 2002

(65) Prior Publication Data

US 2004/0088990 A1 May 13, 2004

(51) Int. Cl.[7] ..... F02C 1/00; F02C 6/08; F02C 3/04

(52) U.S. Cl. ..... 60/782; 60/723; 60/805

(58) Field of Search ..... 60/750, 727, 723, 60/772, 782, 805

(56) References Cited

U.S. PATENT DOCUMENTS

| | | | | | |
|---|---|---|---|---|---|
| 2,658,338 | A | * | 11/1953 | Leduc | 60/805 |
| 3,306,643 | A | * | 2/1967 | Reed | 292/1 |
| 3,309,866 | A | * | 3/1967 | Kydd | 60/772 |
| 4,018,043 | A | * | 4/1977 | Clemmens | 60/39.23 |
| 4,845,940 | A | | 7/1989 | Beer | 60/732 |
| 4,870,823 | A | | 10/1989 | Silvestri, Jr. | 60/652 |
| 4,940,383 | A | | 7/1990 | Silvestri, Jr. | 415/44 |
| 5,333,457 | A | | 8/1994 | Silvestri, Jr. | 60/646 |
| 5,671,597 | A | | 9/1997 | Butler et al. | 60/39.31 |
| 5,826,430 | A | | 10/1998 | Little | 60/736 |
| 6,047,540 | A | * | 4/2000 | Dev | 60/805 |
| 6,217,280 | B1 | | 4/2001 | Little | 415/115 |
| 6,220,034 | B1 | | 4/2001 | Mowill | 60/737 |
| 6,276,123 | B1 | | 8/2001 | Chen et al. | 60/39.141 |
| 6,282,904 | B1 | | 9/2001 | Kraft et al. | 60/739 |
| 2001/0032450 | A1 | | 10/2001 | Little | 60/39.02 |

FOREIGN PATENT DOCUMENTS

| | | | |
|---|---|---|---|
| WO | WO 96/19699 | 6/1996 | F23R/3/12 |
| WO | WO 99/47798 | 9/1999 | F02C/7/12 |

* cited by examiner

*Primary Examiner*—Charles G. Freay

(57) ABSTRACT

A gas turbine combustion system and method used for generating electrical power includes a compressor that receives and compresses air. A first stage turbine nozzle is flowise connected to the compressor and receives a portion of the compressed air from the compressor within a first air flow. A torus configured combustion chamber is positioned around the first stage turbine nozzle and receives a portion of the compressed air from the compressor within a second air flow that is passed through the combustion chamber where air and fuel are mixed and combusted. The air is discharged at the first stage turbine nozzle to mix with the first air while achieving a dry low NOx combustion.

26 Claims, 4 Drawing Sheets

INTEGRATED COMBUSTOR AND NOZZLE FOR A GAS TURBINE COMBUSTION SYSTEM

FIELD OF THE INVENTION

The present invention relates to the field of gas turbine combustion systems used for generating electrical power, and more particularly, this invention relates to a gas turbine combustor integrated with the nozzle of the turbine, such as the first stage nozzle.

BACKGROUND OF THE INVENTION

The combustion systems used in current dry, low NOx (DLN), gas turbine combustion systems are large, complex and expensive. As disclosed in commonly assigned U.S. Pat. No. 6,217,280 to Little and published application no. 2001/0032450 to Little, the disclosures which are hereby incorporated by reference, a gas turbine combustion system of conventional construction is illustrated and generates electrical power by techniques well known to those skilled in the art.

This complicated type of assembly includes a main combustion turbine having a compressor assembly, a combustor assembly with a transition section or alternately an annular combustor, and a first turbine assembly. A flow path extends through the compressor, combustor assembly, transition section, and first turbine assembly, which is mechanically coupled to the compressor assembly by a central shaft. An outer casing creates a compressed air plenum, which encloses a plurality of combustor assemblies and transition sections that are disposed circumferentiality about the central shaft.

This type of gas turbine combustion system operates as a dry, low NOx (DLN) system having low part per million (ppm) NOx emissions. This low ppm NOx emission is necessary to maintain strict environmental standards during operation. As a result, these gas turbine combustion systems are complicated and can be expensive to maintain. It would be desirable if the size and complexity of the gas turbine combustion system could be reduced, allowing a shorter gas turbine with fewer parts without sacrificing the dry low NOx capabilities of current gas turbine combustion systems.

SUMMARY OF THE INVENTION

The present invention provides a reduced size and lower complexity gas turbine combustion system that permits a shorter gas turbine with fewer parts without sacrificing the dry low NOx capability of current gas turbine power generation systems. The cost reduction for a manufacturer and subsequent savings can be passed on to the industry to reduce the cost of electricity over the life cycle of a power plant in which the gas turbine is installed.

In accordance with one aspect of the present invention, a gas turbine combustion system used for generating electrical power includes a compressor that receives and compresses air. A first stage turbine nozzle is flow connected to the compressor and receives a portion of the compressed air from the compressor within a first air flow. A torus configured combustion chamber is positioned around the first stage turbine nozzle and receives a portion of the compressed air from the compressor within a second air flow that is passed through the combustion chamber where air and fuel are mixed and combusted. This combusted mixture is discharged into the first stage turbine nozzle to mix with the first air flow through the first stage turbine nozzle while achieving a dry low NOx combustion.

The first air flow has a velocity through the first stage turbine nozzle for generating sufficient aerodynamic pressures between the first and second air flows to accomplish an adequate air flow split between first and second air flows. The combustion chamber is configured for producing a radially inward flow of air that is discharged into the first stage turbine nozzle to mix with the first flow. In one aspect of the present invention, the fuel-to-air ratio within the combustion chamber is maintained below stoichiometric. The fuel-to-air ratio could be between about 0.18 to about 0.36.

In yet another aspect of the present invention, the combustion chamber includes a backside cooling surface over which compressed air from the compressor is passed to aid in cooling the combustion chamber. A catalytic surface is positioned within the combustion chamber and contacts the air and fuel mixture to initiate and maintain a catalytic reaction of fuel. The combustion chamber further comprises interior walls in which the catalytic surface is positioned. In yet another aspect of the present invention, the combustion chamber further comprises a backside cooling surface over which compressed air is passed to aid in cooling the catalytic surface.

In yet another aspect of the present invention, air is deflected off a compressor exit diffuser into a second air flow that is passed through the combustion chamber where air and fuel are mixed and combusted, and discharged into the first stage turbine nozzle to mix with a first air flow. It is also passed over the backside cooling surface for cooling the combustion chamber.

A method of operating a gas turbine for generating electrical power is disclosed and comprises the step of splitting a compressed air flow from a compressor into a first air flow that passes the compressed air through a first stage turbine nozzle. The compressed air is also split into a second air flow that is passed through a torus configured combustion chamber positioned around the first stage turbine nozzle such that fuel and air are mixed and combusted. The two air flows are mixed at the first stage turbine nozzle, while achieving a dry low NOx combustion.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
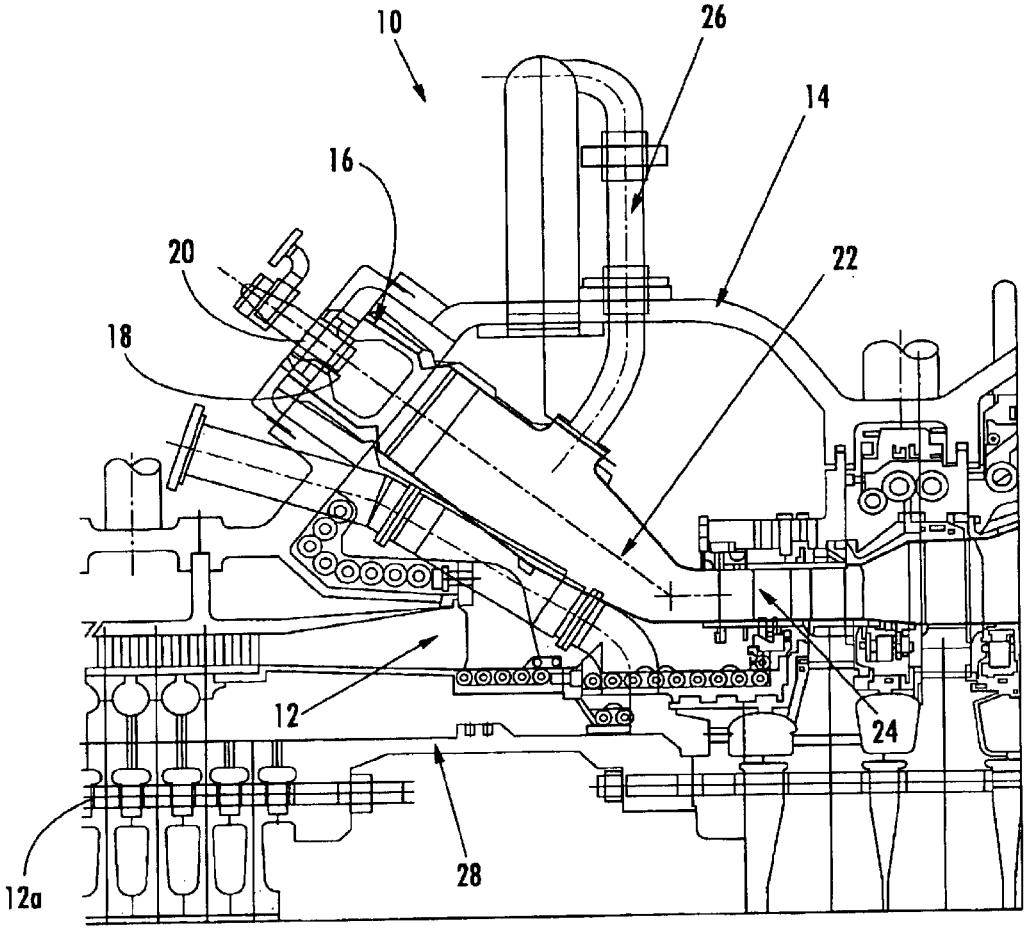
FIG. 1. PRIOR ART
FIG. 1 is a fragmentary, partial sectional and elevation view of a typical, prior art industrial gas turbine and its basic components.

FIG. 1 shows a typical industrial gas turbine combustion system 10 of the present invention in which a compressed air flow leaves the compressor exit diffuser 12, dumps into the large volume contained within the combustor casing 14, and flows through the combustor baskets 16, where fuel is added through the pilot plus three stages 18 of the known DLN systems (each with its own fuel supply manifold) 20. The air/fuel mixture flows through the transitions 22 to the turbine first stage nozzle 24. As known to those skilled in the art, a bypass system 26 provides for bypass of some combustion casing air. The torque tube shaft 28 provides for power transmission to the compressor 12*a*.

The present invention reduces the size and complexity of the combustion system, thus, allowing a shorter gas turbine, with fewer parts, without sacrificing the DLN (dry low NOx) capabilities of the gas turbine combustion system. The cost reduction for the manufacturer and the subsequent savings which can be passed onto the industry will greatly reduce the cost of electricity over the life cycle of the power plant in which the gas turbine combustion system is installed.

Figure 2:
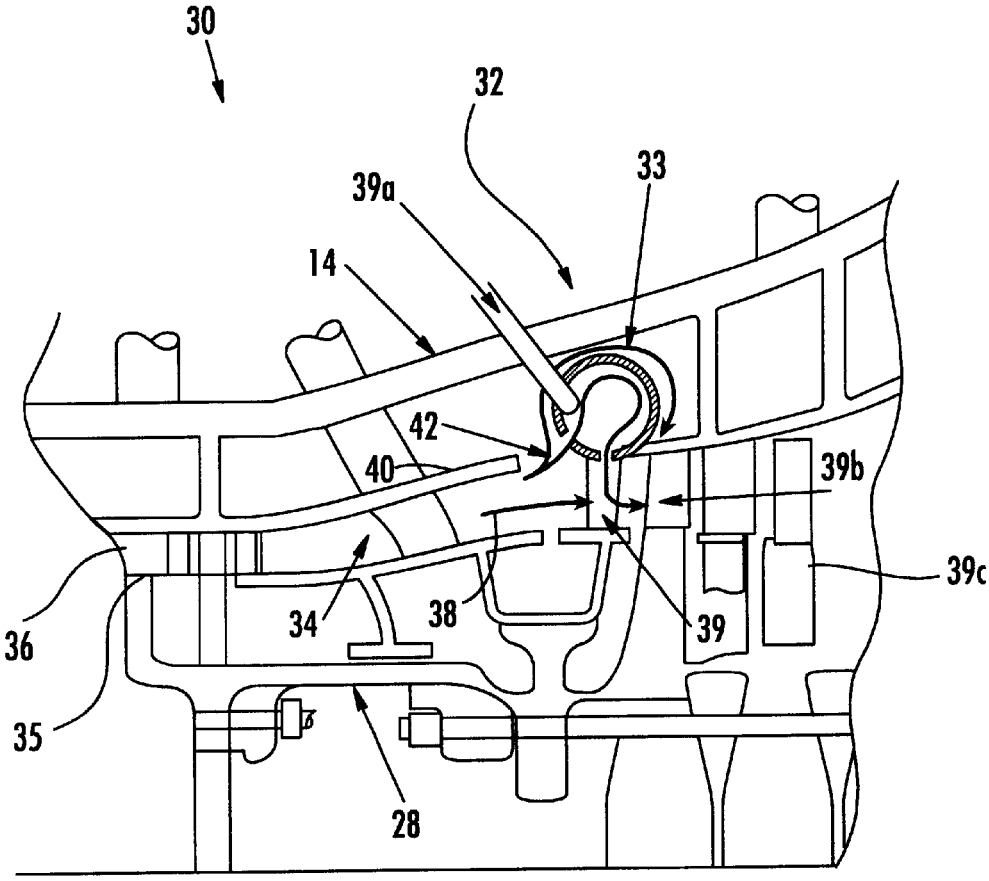
FIG. 2 is a fragmentary and partial sectional and elevation view of an industrial gas turbine of the present invention having a gas turbine combustor integrated with the first stage turbine nozzle.

In the present invention, a combustor operating in a fuel rich condition can be integrated with the first stage turbine nozzle of the turbine by wrapping a combustion chamber around the nozzle assembly in a "torus" or "donut" configuration and using aerodynamic pressure forces to help direct the combustion products into the blade path where combustion is completed. FIG. 2 illustrates a gas turbine combustion system 30 of the present invention where the complicated combustor assembly shown in FIG. 1 is replaced with the combustor assembly 32 shown in FIG. 2 that is more fully integrated with the first stage turbine nozzles.

In the present invention, compressed air exiting the compressor exit diffuser 34 from the compressor 35 is split into two flow paths. A portion of the air from the compressor 36 flows as a first air flow 38 and through the turbine first stage turbine nozzles 39. Substantially the balance of the compressed air from the compressor 35 is directed into a second air flow channel 40 as a second air flow 42 into the combustion assembly 32 having a combustion chamber 33 generally located and positioned over the first stage turbine nozzles 39 in a "donut" or "torus" configuration (or other appropriate similar geometry). Fuel is injected through fuel nozzles 39*a* by techniques and using nozzle equipment known to those skilled in the art. The combustor assembly 32 establishes a flow path that communicates with each first stage turbine nozzle, thus joining the air flows 38, 42 at each first stage turbine nozzle 39 in an area where air plus fuel 39*b* enters the turbine 39*c*. These components are positioned in the gas turbine combustion system such that the aerodynamic pressure forces generated by the air flowing over the first stage turbine nozzles 39 provide sufficient pressure differential between the first and second air flows 38, 42 to accomplish efficiently the desired air flow split.

The required amount of air will enter the torus configured combustion chamber 33, and compressed air plus the products of combustion will flow radially inwards in a manner such that the air will be ingested into the main compressor delivery air flowing through the first stage turbine nozzles 39.

There are two alternate approaches to provide for the achievement of dry low NOx, as described below. FIG. 2 illustrates the basic structure in accordance with the present invention where the length of the apparatus can be greatly reduced, the size of the combustor casing minimized, the fuel supply system simplified, and the complex baskets and transitions eliminated.

Figure 3A:
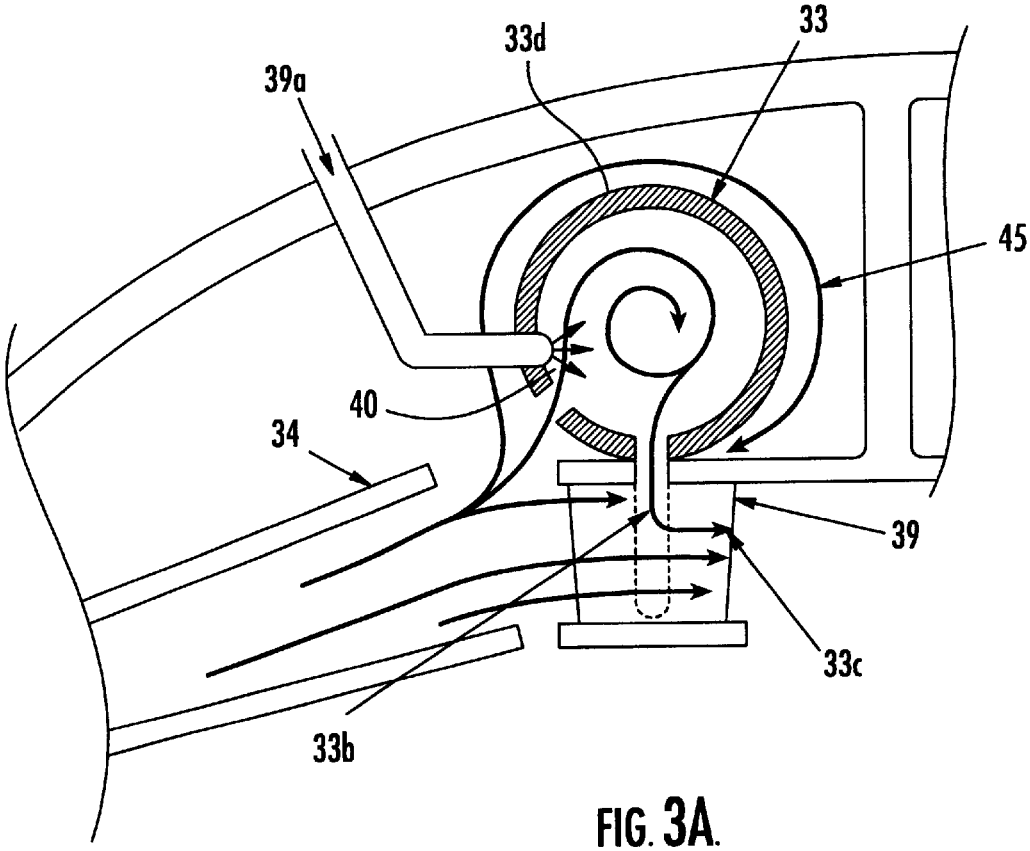
FIG. 3A is a partial sectional, fragmentary view of a cross-section through the "torus" or "donut" configured combustion chamber showing the vane in accordance with a first embodiment of the present invention.
Figure 3B:
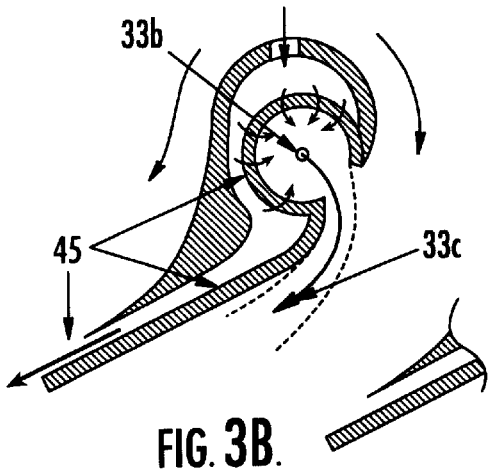
FIG. 3B is a partial sectional, fragmentary view through the middle of the first stage turbine nozzle vane in accordance with the first embodiment.

The first embodiment shown in FIGS. 3A and 3B uses rich quench lean combustion. In this embodiment of the present invention, all of the fuel is introduced into the compressed air that enters into the second flow channel 40 that forms the combustion chamber 33. The fuel and air are efficiently mixed (by methods known to those skilled in the art), providing a fuel rich combustible mixture. This mixture is ignited and allowed to burn within the combustion chamber, which wraps around the first stage turbine nozzles 39 in the "donut" or "torus" shaped arrangement.

In one aspect of the present invention, fuel rich conditions are established by maintaining the ratio of fuel-to-air (F/A) below stoichiometric and typically in the range of 0.18 to 0.36 (equivalence ratios of 1.3 to 3.0). These conditions would correspond to combustion temperatures from about 1600° F. to about 3500° F. Under these fuel rich combustion conditions, no thermal NOx is produced. The hot combustion gases contained in the combustion chamber 33 will flow radially inwards through or over the nozzle structure of the first stage turbine nozzle 39 and be ingested into and mixed with the first stage turbine nozzle air flow.

The fuel rich combustion products 33*b* (FIGS. 3A and 3B) upon contacting and mixing with the first stage turbine nozzle air flow 38, will react, releasing additional fuel energy and completing the combustion process. There is also some quenching to form quenched combustion products 33*c*. The mixed gas temperature will either increase or decrease depending on the stoichiometry of the fuel rich gas stream. Little or no NOx is generated in this process because of the quick mix-out of the two gas streams. FIGS. 3A and 3B also illustrate that compressor delivery air can be used to cool the combustion chamber 33 and the hot surfaces of the first stage turbine nozzle 39 if required by passing cooling air 45 from the compressor 35 along a backside cooling surface 33*d* of the combustion chamber 33. As shown in FIG. 3B, some cooling air 45 passes into the area of the nozzles 39 as shown by the arrows indicating flow.

Figure 4A:
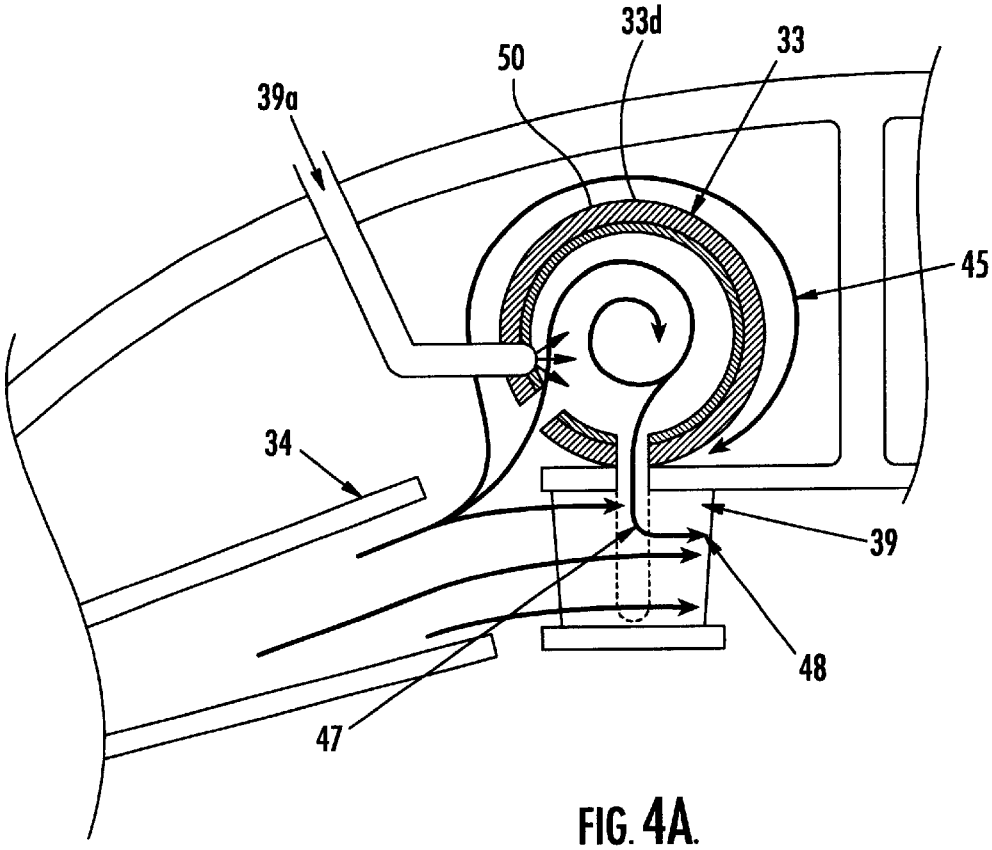
FIG. 4A is a partial sectional, fragmentary view of a cross-section through the "torus" or "donut" configured combustion chamber showing the vane in accordance with a second embodiment of the present invention where a catalytic liner or elements are positioned along the inside surface of the combustion chamber.
Figure 4B:
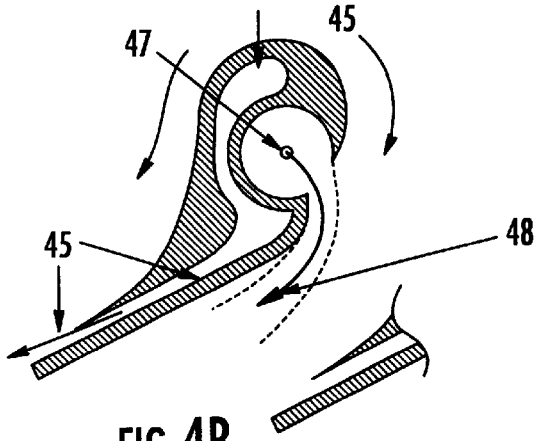
FIG. 4B is a partial sectional, fragmentary view through the middle of the first stage turbine nozzle vane in accordance with the second embodiment.

A second embodiment of the present invention is shown in FIGS. 4A and 4B using catalytic combustion. In this embodiment, catalytic active surfaces 50 are integrated into the combustion chamber such that the fuel rich gas contacts the catalytic active surfaces 50 initiating and sustaining a catalytic oxidation reaction of the fuel. Sufficient catalytic surface is provided such that 20% to 40% of the hydrocarbon content of that fuel is reacted, releasing heat and raising an average reformed fuel or gas 47 temperature to approximately 1600° F. or higher. No significant NOx is generated in the catalytic process.

In this embodiment, the catalytic active surfaces 50 are cooled by passing air along the backside cooling surface 33*d* using a portion of the air from the compressor exit diffuser 34 to maintain the catalytic substrate at appropriate temperature conditions. Catalytic active materials such as Pt and Pd or other noble metals (known to the art) could be used. This cooling air is heated in the process and mixed with the hot reformed fuel. These hot combustion gases flow radially inwards through or over a nozzle structure 39 and are ingested into and mixed with the turbine first stage nozzle air flow. The fuel rich combustion products, upon contacting and mixing with the turbine first stage nozzle air flow of the first air flow, will react, releasing additional fuel energy and completing the combustion process as an auto-ignited combustion 48. Little or no NOx is generated in this process because of the quick mix-out of the two gas streams.

Although many specific geometries could be used (tubes, channels, plates, etc.) to backside cool the catalytic surfaces, in a preferred embodiment, the combustion chamber 33 interior wall is covered with a catalytic coating. A portion of the compressor exit diffuser 34 air flow that forms the second flow path for the second air flow is used as cooling air 45 for backside cooling as illustrated. This can be efficiently accomplished in a counter current flow, a technique well known to those skilled in the art of heat transfer. This heated air is introduced into the "donut" or "torus" shaped catalytic coated, combustion chamber 33 with a high swirl component. Fuel is introduced at or along the flow path in a manner that supports efficient mixing and enhances (or drives) flow swirl. This fuel rich mixture contacts the catalytic coated walls of the combustion chamber, effecting said catalytic reaction. The high swirl component ensures efficient oxygen mass transfer to the catalytic surfaces, sustaining catalytic reaction and fuel conversion (a factor limiting current catalytic combustion reactor designs).

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. A gas turbine combustion system comprising:

a compressor that receives and compresses air;

a first stage turbine nozzle flow connected to the compressor that receives a portion of the compressed air from the compressor within a first air flow; and a torus configured combustion chamber positioned around the first stage turbine nozzle that receives a portion of the compressed air from the compressor within a second air flow that is passed through the combustion chamber where air and fuel are mixed and combusted and discharged at the first stage turbine nozzle to mix with the first air flow through the first stage turbine nozzle while achieving a dry low NOx combustion.

2. A gas turbine combustion system according to claim 1, wherein the first air flow has a velocity through the first stage turbine nozzle for generating sufficient aerodynamic pressures between the first and second air flows to accomplish an adequate air flow split between first and second air flows.

3. A gas turbine combustion system according to claim 1, wherein the first stage turbine nozzle is configured for producing a radially inward flow of air that is discharged at the first stage turbine nozzle to mix with the first air flow.

4. A gas turbine combustion system according to claim 1, wherein the fuel-to-air ratio within the combustion chamber is maintained below stoichiometric.

5. A gas turbine combustion system according to claim 4, wherein the fuel-to-air ratio within the combustion chamber is about 0.18 to about 0.36.

6. A gas turbine combustion system according to claim 1, wherein the combustion chamber further comprises a backside cooling surface over which compressed air from the compressor is passed to aid in cooling the combustion chamber.

7. A gas turbine combustion system according to claim 1, wherein the combustion chamber further comprises a catalytic surface positioned within the combustion chamber for contacting the air and fuel mixture to initiate and maintain a catalytic reaction of fuel.

8. A gas turbine combustion system according to claim 7, wherein the combustion chamber further comprises interior walls on which the catalytic surface is positioned.

9. A gas turbine combustion system according to claim 8, wherein the combustion chamber further comprises a backside cooling surface over which compressed air is passed to aid in cooling the catalytic surface.

10. A gas turbine combustion system comprising:

a compressor that receives and compresses the air, said compressor including a compressor exit diffuser;

a first stage turbine nozzle flow connected to the compressor that receives a portion of the compressed air from the compressor within a first air flow; and a torus configured combustion chamber positioned around the first stage turbine nozzle and having a backside cooling surface such that air is deflected off the compressor exit diffuser into a second air flow that is passed through the combustion chamber where air and fuel are mixed and combusted and discharged at the first stage turbine nozzle to mix with the first air flow through the first stage turbine nozzle while achieving a dry low NOx combustion and over the backside cooling surface for cooling the combustion chamber.

11. A gas turbine combustion system according to claim 10, wherein the first air flow has a velocity through the first stage turbine nozzle for generating sufficient aerodynamic pressures between the first and second air flows to accomplish an adequate air flow split between first and second air flows.

12. A gas turbine combustion system according to claim 10, wherein the first stage turbine nozzle is configured for producing a radially inward flow of air that is discharged at the first stage turbine nozzle to mix with the first air flow.

13. A gas turbine combustion system according to claim 10, wherein the fuel-to-air ratio within the combustion chamber is maintained below stoichiometric.

14. A gas turbine combustion system according to claim 13, wherein the fuel-to-air ratio within the combustion chamber is about 0.18 to about 0.36.

15. A gas turbine combustion system according to claim 10, wherein the combustion chamber further comprises a catalytic surface positioned within the combustion chamber for contacting the air and fuel mixture to initiate and maintain a catalytic reaction of fuel.

16. A gas turbine combustion system according to claim 15, wherein the combustion chamber further comprises interior walls on which the catalytic surface is positioned.

17. A method of operating a gas turbine combustion system comprising the steps of:

splitting a compressed air flow from a compressor into a first air flow that passes the compressed air through a first stage turbine nozzle, and into a second air flow that passes the compressed air through a torus configured combustion chamber positioned around the first stage turbine nozzle such that fuel and air are mixed and combusted; and mixing the two air flows at the first stage turbine nozzle while achieving a dry low NOx combustion.

18. A method according to claim 17, and further comprising the step of generating sufficient aerodynamic pressures by flowing the first air flow over the first stage turbine nozzle to provide sufficient pressure differential between the first and second air flows to accomplish an adequate air flow split.

19. A method according to claim 17, and further comprising the step of flowing compressed air and fuel during combustion within the combustion chamber radially inward and discharging the air from the combustion chamber to mix with the first air flow at the first stage turbine nozzle.

20. A method according to claim 17, and further comprising the step of maintaining the fuel-to-air ratio within the combustion chamber below stoichiometric.

21. A method according to claim 20, and further comprising the step of maintaining the fuel-to-air ratio within the combustion chamber at about 0.18 to about 0.36.

22. A method according to claim 17, and further comprising the step of mixing a portion of fuel with the second air flow passing through the first stage turbine nozzle to aid in controlling combustion process conditions.

23. A method according to claim 17, and further comprising the step of passing air from the compressor over a backside cooling surface of the combustion chamber to aid in cooling the combustion chamber.

24. A method according to claim 17, and further comprising the step of initiating and sustaining a catalytic reaction of fuel within the combustion chamber by contacting the gas and fuel mixture with a catalytic surface positioned within the combustion chamber.

25. A method according to claim 24, wherein the catalytic surface is positioned on interior walls of the combustion chamber.

26. A method according to claim 17, of producing a counter current flow of cooling air along a backside of the combustion chamber to aid in cooling the catalytic surface.

* * * * *